US006960098B1

(12) United States Patent
Tseng

(10) Patent No.: US 6,960,098 B1
(45) Date of Patent: Nov. 1, 2005

(54) PIPE COMPONENT PRE-EMBEDDED SOCKET STRUCTURE

(76) Inventor: Mei-Chuan Tseng, No.7-6, Guangcian Road, Beidou Township, Changhua Hsien (TW)

( * ) Notice: Subject to any disclaimer, the term of this patent is extended or adjusted under 35 U.S.C. 154(b) by 0 days.

(21) Appl. No.: 10/888,995

(22) Filed: Jul. 13, 2004

(51) Int. Cl.[7] ..... H01R 11/00
(52) U.S. Cl. ..... 439/502; 108/50.02
(58) Field of Search ..... 439/131, 214, 439/136, 502; 108/60, 50.02

(56) References Cited

U.S. PATENT DOCUMENTS 4,094,256 A * 6/1978 Holper et al. ..... 108/50.02
4,489,435 A * 12/1984 Moshier ..... 704/244
4,792,881 A * 12/1988 Wilson et al. ..... 361/827
5,065,832 A * 11/1991 Mark ..... 108/60
5,397,242 A * 3/1995 Laisne et al. ..... 439/101
5,397,243 A * 3/1995 MacMurdo, Sr. ..... 439/136
5,516,298 A * 5/1996 Smith ..... 439/131
6,183,280 B1 * 2/2001 Laukhuf ..... 439/214

* cited by examiner

*Primary Examiner*—Phuong Dinh
(74) *Attorney, Agent, or Firm*—Rabin & Berdo, P.C.

(57) ABSTRACT

A pipe component pre-embedded socket structure in which computer desk, shelf, and cabinet pipe members have pre-embedding holes and openings, with a pre-embedded socket installed in a pre-embedding hole. The pre-embedded socket connector face plate has various sockets correspondent to the rear panel sockets of a computer main system, the extension cables of which are inserted into a hollow pipe member and then drawn out of the lateral frame hollow pipe member opening and through an attached protective pliant tube. The structure provides for plug-in connections between the main system and the monitor, mouse, amplified speakers, and other peripherals, enabling simple and rapid set-up tasks, while affording a tidy and attractive appearance.

5 Claims, 8 Drawing Sheets

PIPE COMPONENT PRE-EMBEDDED SOCKET STRUCTURE

BACKGROUND OF THE INVENTION

1) Field of the Invention

The invention herein relates to a pipe component pre-embedded socket structure in which a pre-embedded socket in pipe stock provides for usage on computer desks, shelves, cabinets, and other furniture and the direct plugging in of cable connectors from conventional computer main system and peripherals cables, thereby achieving simple and rapid set-up tasks, while affording a tidy and attractive appearance.

2) Description of the Prior Art

The following two types of conventional computers are set up on desks: One of the types set up are desk-top computers (as shown in FIG. 1); when such computers are set up on a computer desk 20, the main system 10 is situated along the lower extent of the computer desk 20, the keyboard 12 is placed on a sliding tray 22 under the desk surface 21, and the monitor 13, the mouse 14, the amplified speakers 15, and other peripherals are arranged on the desk surface 21, following which cables A of the peripherals are first routed through an opening 211 formed in the desk surface 21, the cable connectors B at the rear extent of the computer desk 20 are respectively plugged into the rear panel sockets 11 of the main system 10 at the lower extent of the computer desk 20, and the main system 10 is located to a suitable area below the computer desk 20 to thereby complete the setting up of the computer.

As such, the said prior art structure has the following shortcomings: The main system 10 is situated at the lower extent of the computer desk 20 and whenever peripherals are added or removed, the main system 10 under the computer desk 20 must be moved outward in order to plug in or unplug the cable connectors B routed through the desk surface 21 opening 211 to and from the main system 10 rear panel sockets 11, making the set-up task complicated and inconvenient.

In the case of notebook computers (as shown in FIG. 2), these are directly placed at a site on the computer desk 40 desk surface 41 having a multi-apertured power supply socket 42; when the notebook computer 30 is to be used, the power supply connector 31 is directly plugged into the power supply socket 42 on the desk surface 41 to enable utilization.

As such, the said prior art structure has the following shortcomings: The computer desk 40 consists of a multi-apertured power supply socket 42 directly disposed in the desk surface 41 that only provides for plugging in of a notebook computer 30 power supply connector 31.

In view of the said shortcomings, the applicant of the invention herein conceived of a thoughtful and original idea based on many years of design experience and extensive investigation that, following repeated sample testing and numerous refinements, culminated in the introduction of the invention herein.

SUMMARY OF THE INVENTION

The primary objective of the invention herein is to provide a pipe component pre-embedded socket structure, the pre-embedded socket of which is directly disposed on a computer desk lateral frame, the extension cables inserted into a lateral frame hollow pipe member and then drawn out of a protective pliant tube attached to the lateral frame, thereby providing for direct plugging in of peripheral cable connectors for utilization with a conventional computer main system to thereby enable simple and rapid set-up.

Another objective of the invention herein is to provide a pipe component pre-embedded socket structure that provides for plug-in connections between the main system and the monitor, mouse, amplified speakers, and other peripherals, while the pre-embedded socket extension cables are contained in the hollow pipe member and a protective pliant tube, thereby affording an overall appearance that is tidy and attractive.

DETAILED DESCRIPTION OF THE INVENTION

The brief description of the drawings are accompanied below by the detailed description of the present invention.

Figure 1:
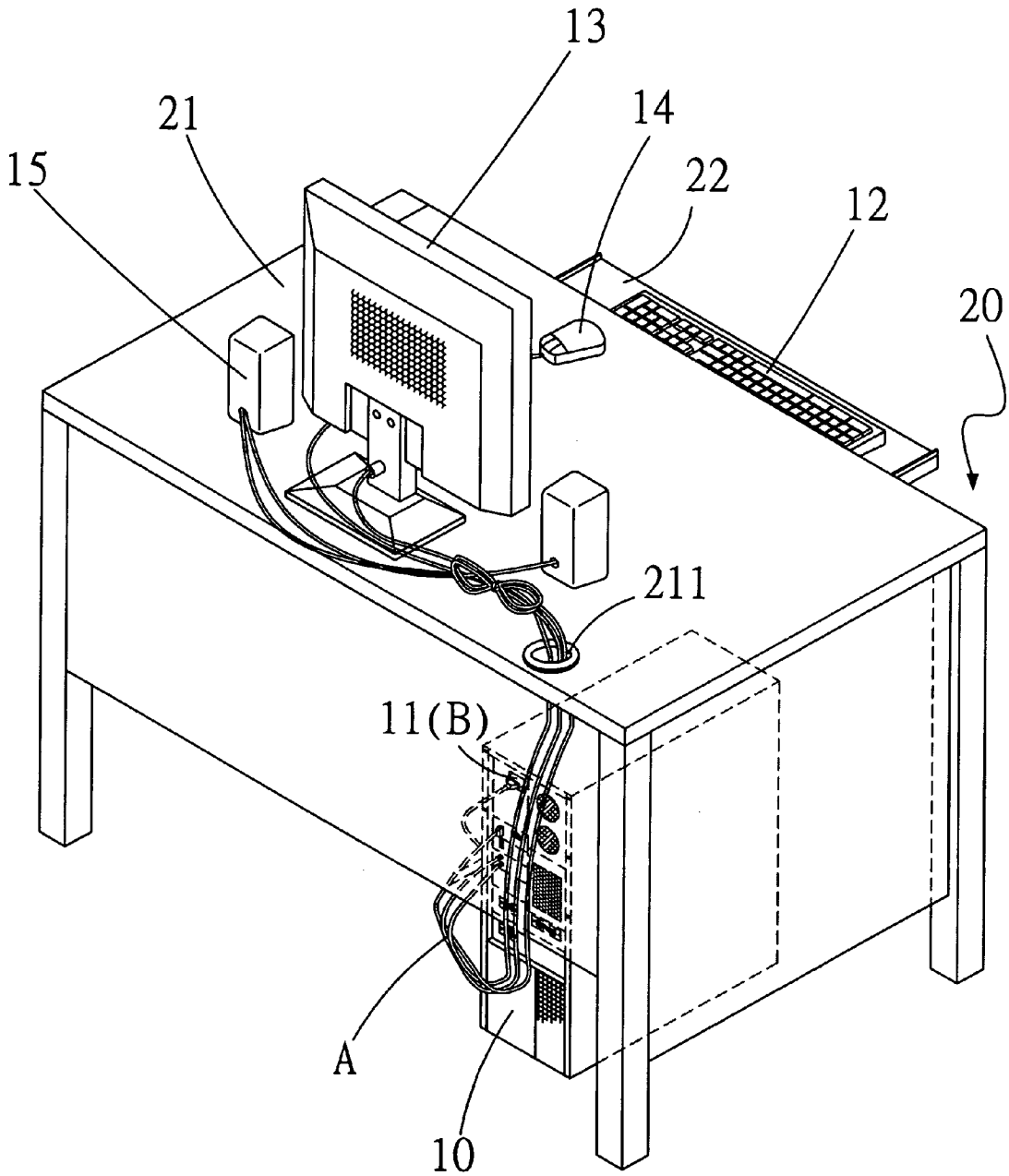
FIG. 1 Prior Art
FIG. 1 is an isometric drawing of the prior art.
Figure 2:
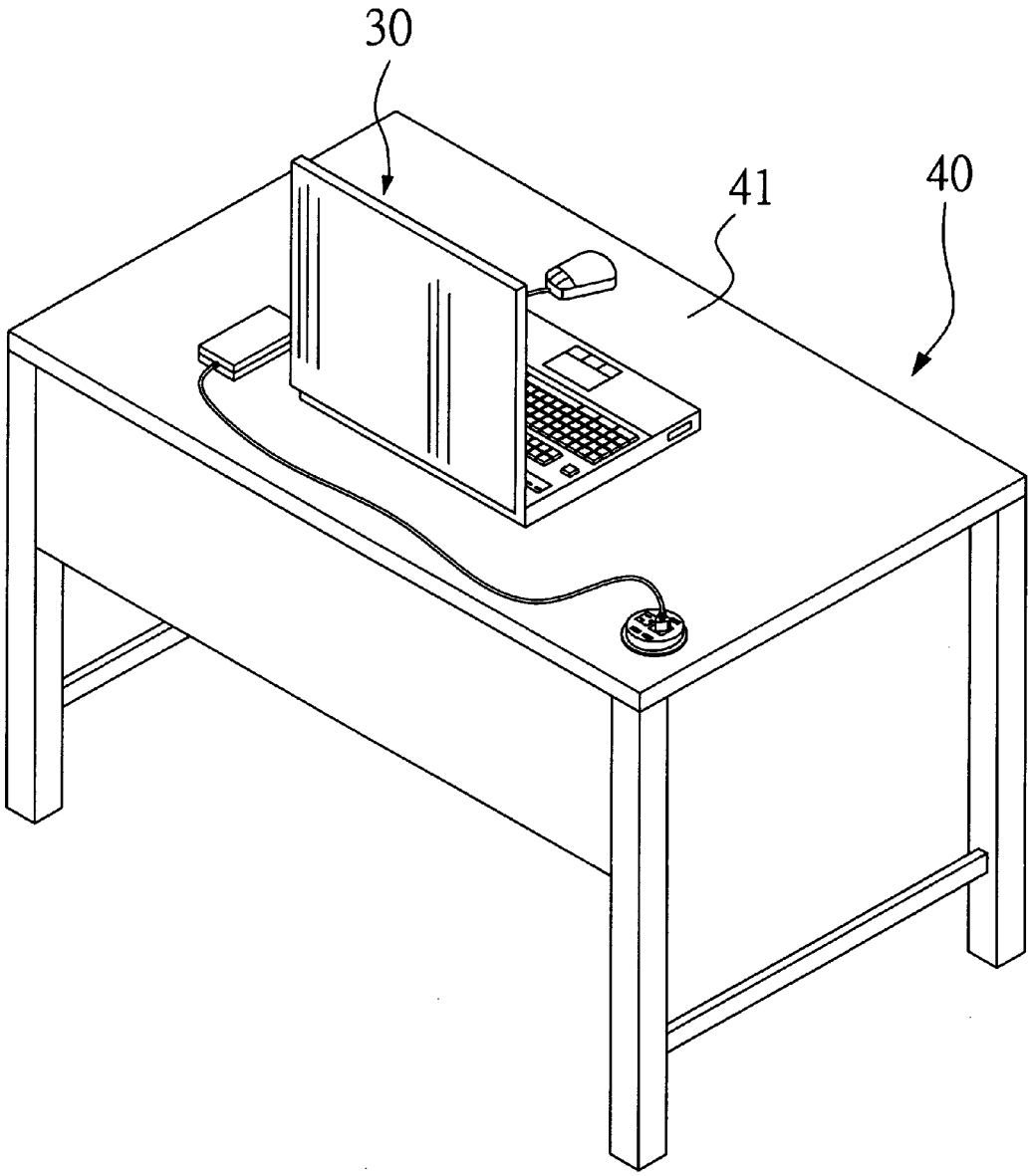
FIG. 2 Prior Art
FIG. 2 is an isometric drawing of another example of the prior art.
Figure 3:
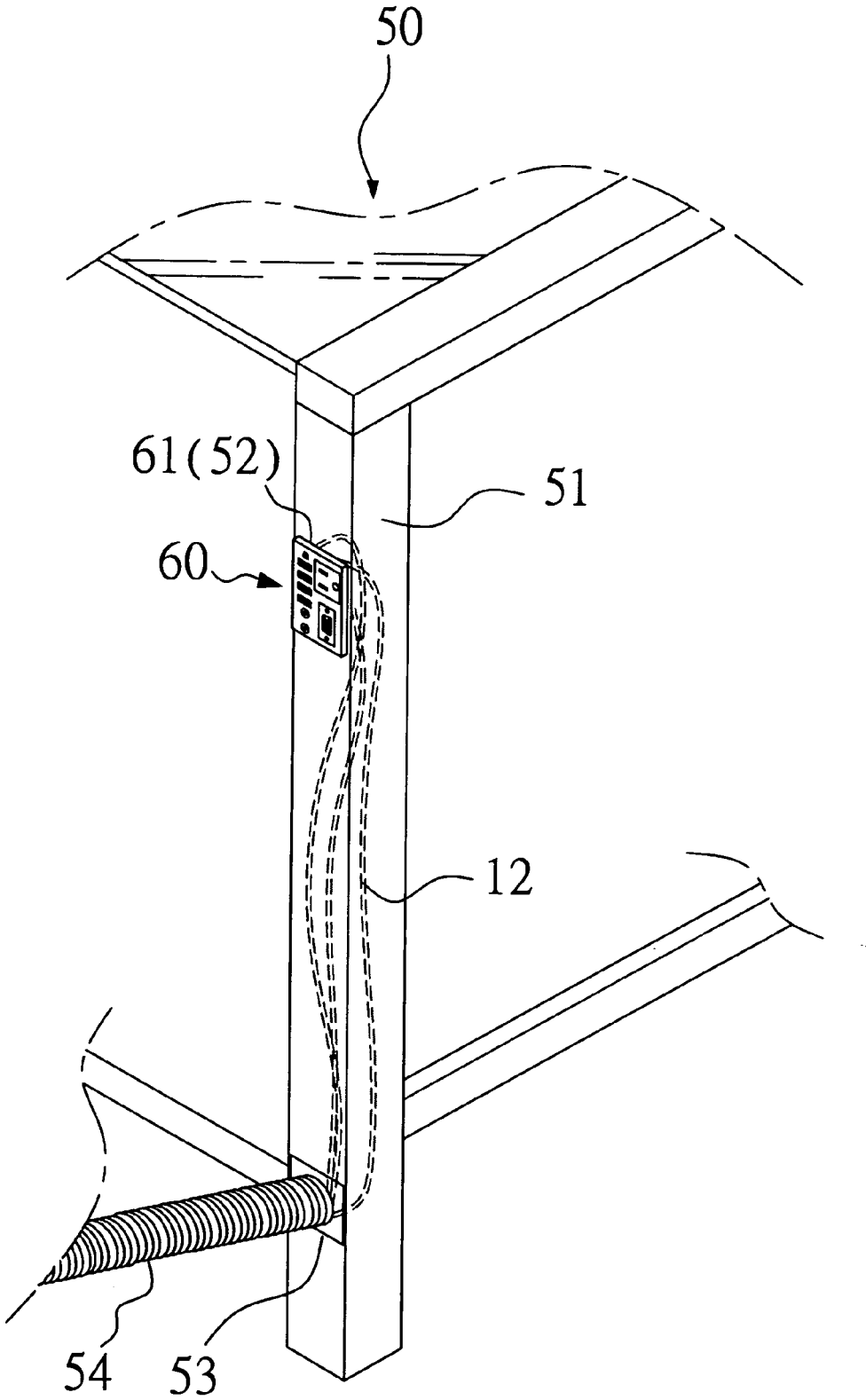
FIG. 3 is an isometric drawing of an installation of the invention herein.
Figure 4:
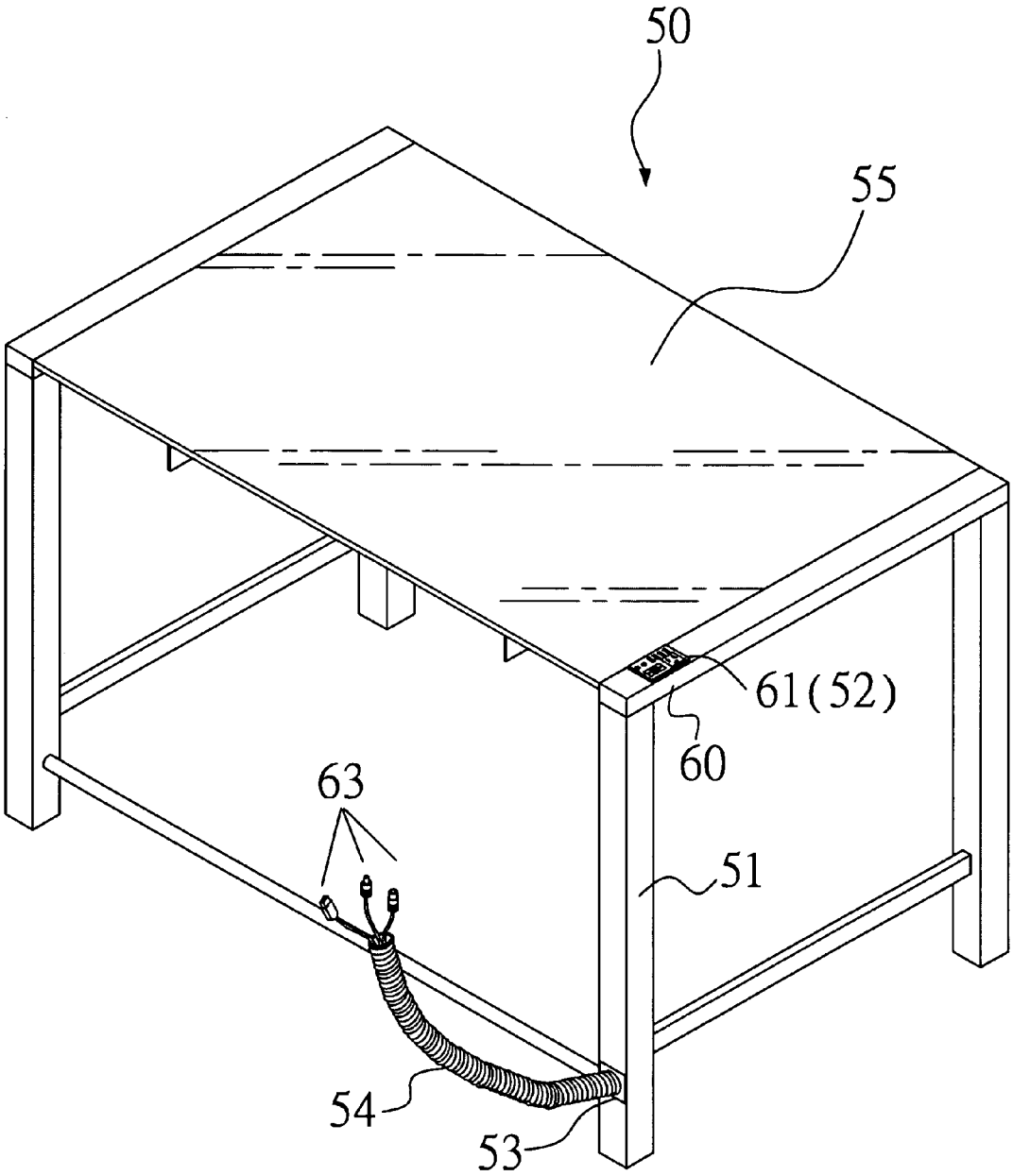
FIG. 4 is an isometric drawing of another installation of the invention herein.
Figure 5:
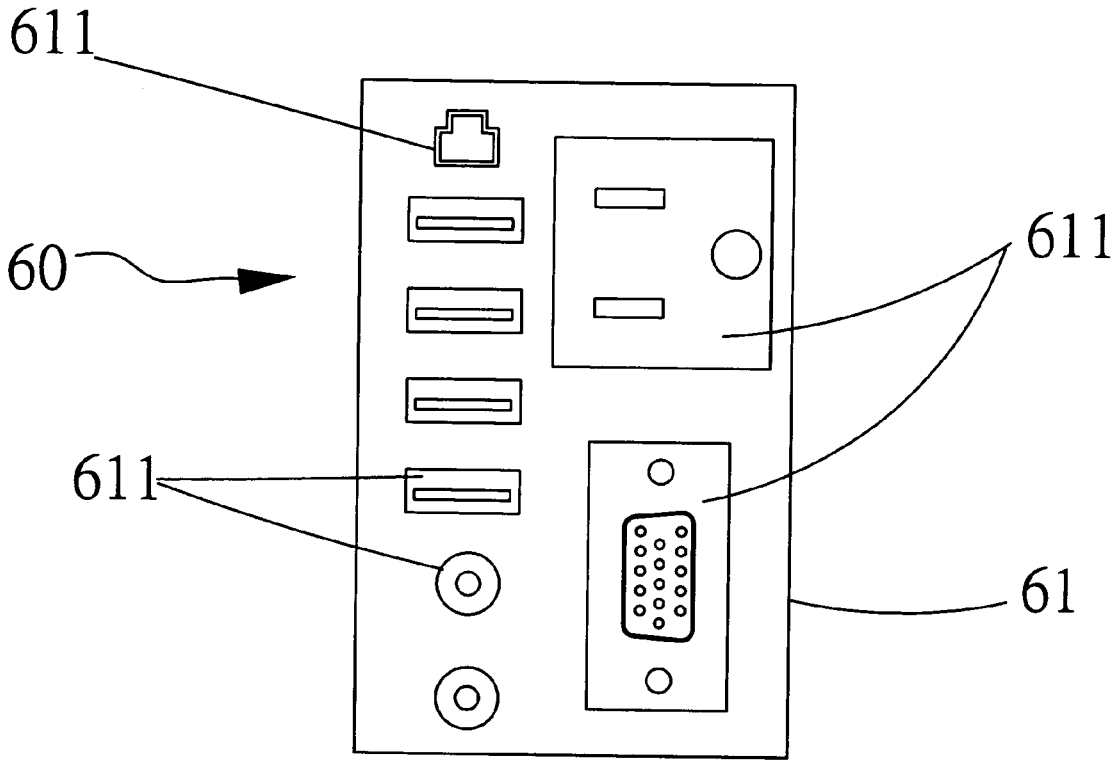
FIG. 5 is an orthographic drawing of the connector face plate of the invention herein.

Referring to FIG. 3, FIG. 4, and FIG. 5, the lateral frames at the two sides of the computer desk 50 consists of hollow pipe members 51 conjoined at the corners into a contiguous arrangement and, at the same time, openings 52 and 53 are disposed at appropriate positions in the upper and lower extent of the lateral frame hollow pipe members 51; a protective pliant tube 54 is attached to the opening 53 area, and the pre-embedded socket 60 connector face plate 61 consists of various sockets 611 (such as a power supply, monitor, amplifier, mouse, printer, scanner, microphone, Internet, CD, CD-R, and digital camera socket, etc.) correspondent to the rear panel sockets 11 of a computer main system 10 as well as extension cables 62 respectively routed from the sockets 611 of the pre-embedded socket 60; when the pre-embedded socket 60 connector face plate 61 is installed in the computer desk 50 lateral frame opening 52, the extension cables 62 are inserted into a hollow pipe member 51 and then drawn out of the lateral frame hollow pipe member 51 opening 53.

Figure 6:
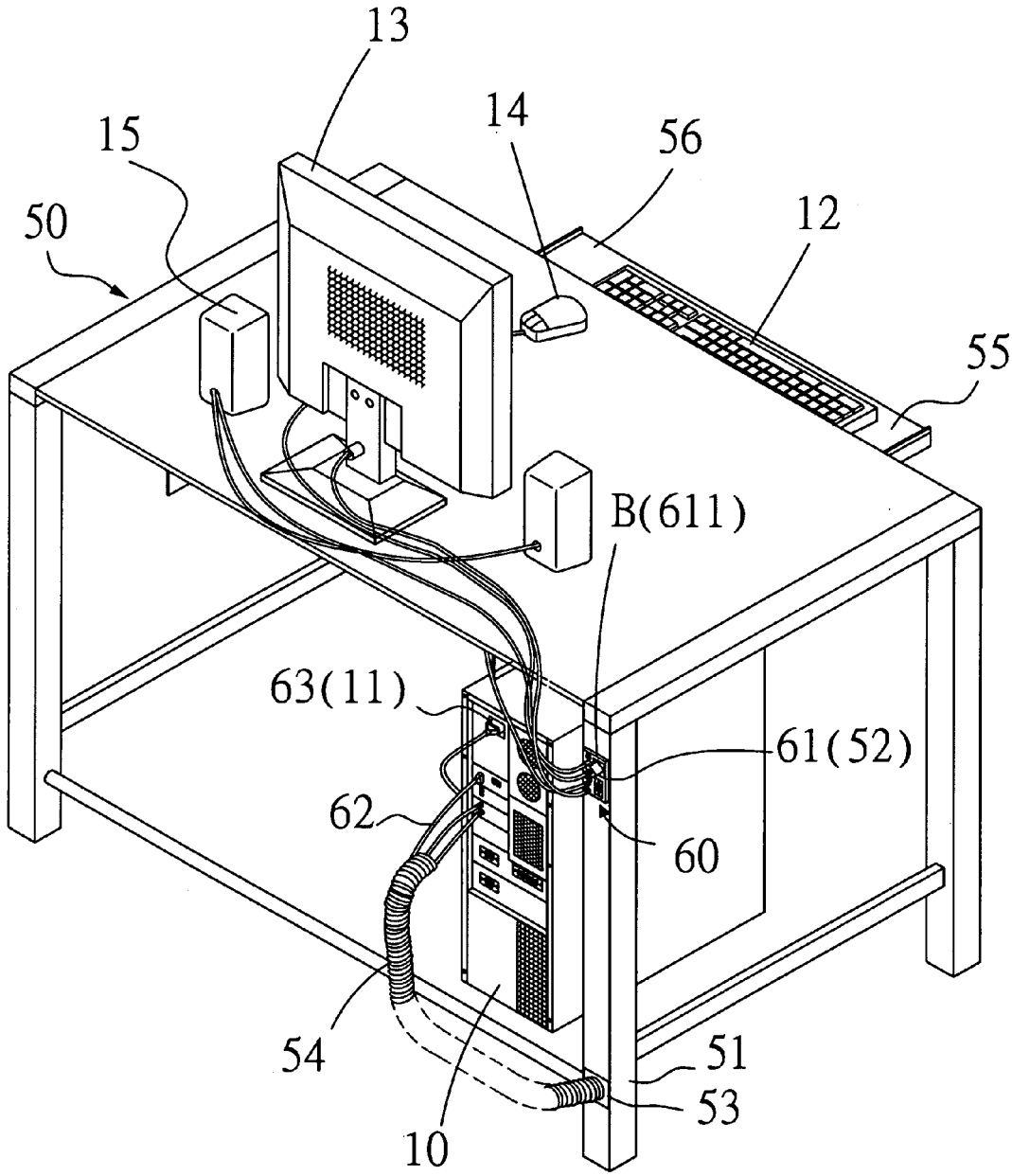
FIG. 6 is an isometric drawing of the invention herein during utilization.

When a computer is set up at the computer desk 50 (as shown in FIG. 6), the main system 10 is situated at an appropriate area along the lower extent of the computer desk 50, the keyboard 12 is placed on a sliding tray 56 under the desk surface 56, with the monitor 13, the mouse 14, the amplified speaker 15, and other peripherals arranged on the desk surface 55, following which the connectors 63 of the pre-embedded socket 60 extension cables 62 are first plugged into the main system 10 rear panel sockets 11 and then the cable connectors B of the peripherals are directly plugged into the sockets 611 of the pre-embedded socket 60 connector face plate 61, thereby completing the setting up of the computer.

Figure 8:
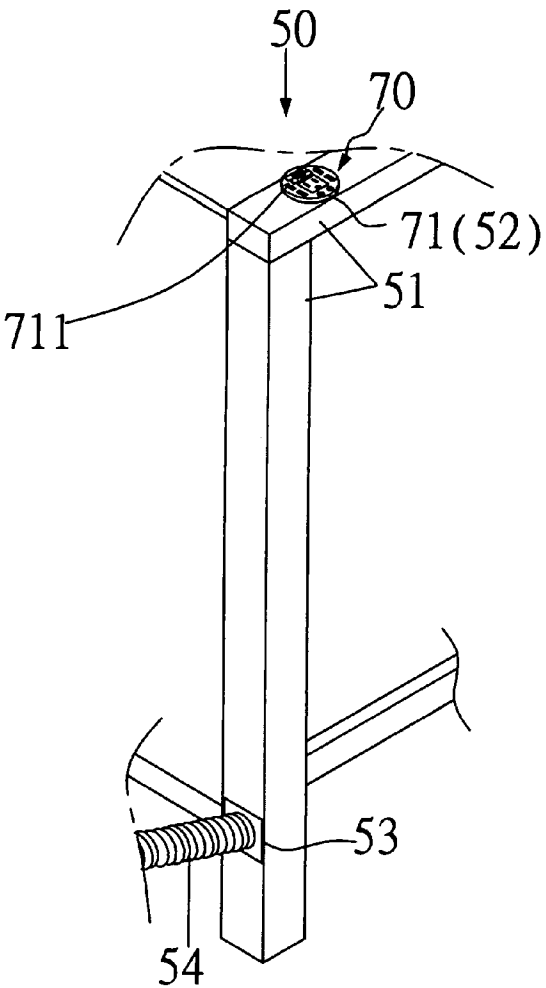
FIG. 8 is an isometric drawing of an another embodiment of the invention herein.
Figure 7:
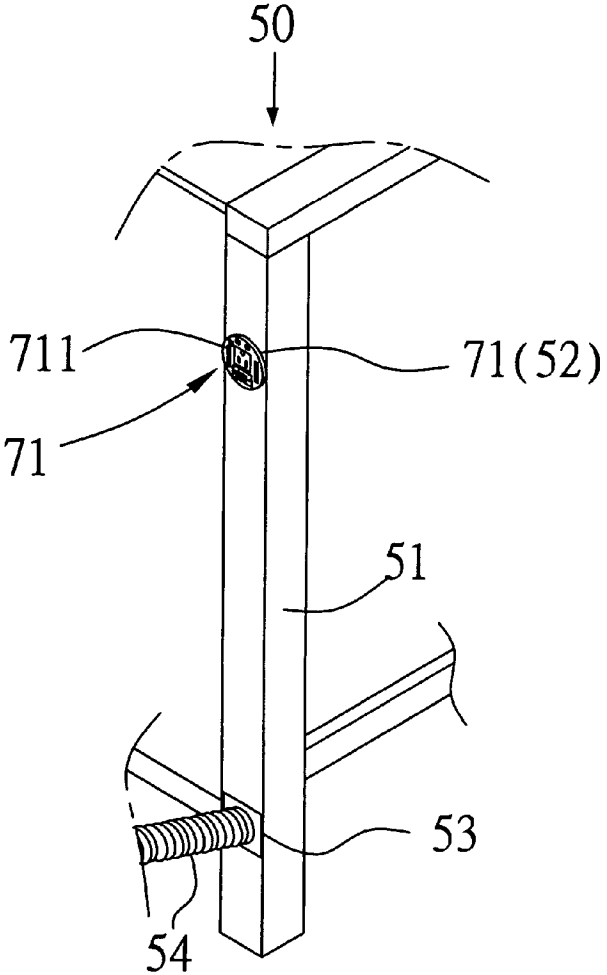
FIG. 7 is an isometric drawing of an embodiment of the invention herein.
Figure 9:
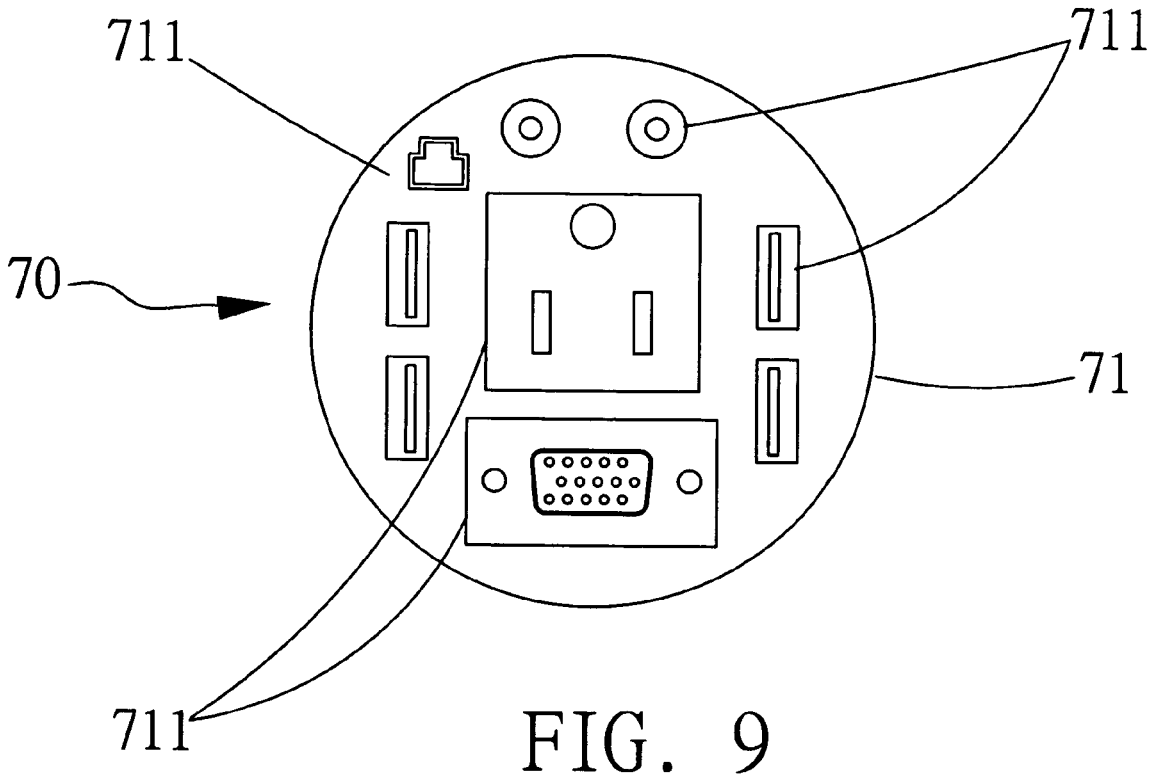
FIG. 9 is an orthographic drawing of another connector face plate embodiment of the invention herein.

Additionally, the pre-embedded socket of the invention herein, as indicated in FIG. 7, FIG. 8, and FIG. 9, can be equipped such that the pre-embedded socket 70 connector face plate 71 consists of various sockets 711 correspondent to the rear panel sockets 11 of a computer main system 10 as well as extension cables 72 respectively routed from the sockets 711 of the pre-embedded socket 70; when the pre-embedded socket 70 connector face plate 71 is installed in the computer desk 50 lateral frame opening 52, the extension cables 72 are inserted into a hollow pipe member 51 and then drawn out of the lateral frame hollow pipe member 51 opening 53 and through the attached protective pliant tube 54.

The said general structural embodiments obtain the following advantages: 1) The pre-embedded sockets 60 and 70 are directly installed into the computer desk 50 lateral frames and the extension cables 62 and 72 inserted into the lateral frame hollow pipe member 51 and then drawn out of the protective pliant tube 54 attached to the lateral frame, thereby providing for the direct plugging in of typical computer main system 11 and peripheral cable connectors B to achieve simple and rapid set-up tasks. 2) Since the disposing of the pre-embedded sockets 60 and 70 in the computer desk 50 lateral frame provides for plug-in connections between the main system 10 and the monitor 13, mouse 14, amplified speakers 15, and other peripherals, while the pre-embedded socket 60 and 70 extension cables 62 and 72 are contained in the hollow pipe member 51 and the protective pliant tube 54, the overall appearance is tidy and attractive.

In summation of the foregoing section, since the invention herein is already of an advanced innovative structure that possesses improved original content, while also capable of achieving industrial utility and progressiveness, and thus meets patent law regulations, the present invention is lawfully submitted for patent application to the patent bureau for review and the granting of the commensurate patent rights.

However, the said description only elaborates the most preferred embodiments of the invention herein and shall not be construed as limitation of the scope of the present invention; all modification and embellishments based on the patent application claims of invention herein shall remain proprietary to and protected under the claims of present invention.

What is claimed is:

1. A computer desk, comprising:

a work-surface shelf;

hollow pipe members supporting the shelf, the hollow pipe members including at least one socket hole and at least one opening therein;

a connector face plate installed in the socket hole, wherein at least one of power supply, monitor, amplifier, mouse, printer, scanner, microphone, Internet, CD, CD-R, and digital camera terminals are mounted in the connector face plate; and extension cables extending from the connector face plate through the hollow pipe members to the opening and then into a protective pliant tube, the pliant tube being attached at the opening, the extension cables protruding from an open end of the pliant tube distal the hollow pipe member opening.

2. The computer desk according to claim 1, wherein the socket hole is located on a vertical surface of one of the hollow pipe members.

3. The computer desk according to claim 1, wherein the socket hole is located on an upper surface of one of the hollow pipe members adjacent to a side of the shelf.

4. The computer desk according to claim 3, wherein the connector face plate is generally coplanar with an upper surface of the shelf.

5. The computer desk according to claim 3, wherein the one of the hollow pipe members wherein the socket hole is located is disposed is a generally horizontal member.

* * * * *